US007013680B1

(12) United States Patent
Adams

(10) Patent No.: US 7,013,680 B1
(45) Date of Patent: Mar. 21, 2006

(54) METHOD TO PREVENT DEKNITTING

(75) Inventor: Fred Adams, Decatur, AL (US)

(73) Assignee: Lakeland Industries INC, Ronkonkoma, NY (US)

( * ) Notice: Subject to any disclaimer, the term of this patent is extended or adjusted under 35 U.S.C. 154(b) by 0 days.

(21) Appl. No.: 11/108,367

(22) Filed: Apr. 18, 2005

(51) Int. Cl.
*D04B 9/58* (2006.01)

(52) U.S. Cl. ..... 66/172 R

(58) Field of Classification Search ..... 66/172 E, 66/171, 172 R, 173
See application file for complete search history.

(56) References Cited

U.S. PATENT DOCUMENTS 2,082,779 A * 6/1937 Buchholz ..... 66/172 R
3,255,613 A * 6/1966 Burd ..... 66/172 R
3,990,115 A * 11/1976 Nester ..... 2/239
4,194,249 A * 3/1980 Thorneburg ..... 2/239
5,428,975 A * 7/1995 Lee et al. ..... 66/178 R
6,053,014 A * 4/2000 Cooper ..... 66/172 E
6,223,565 B1 * 5/2001 Cooper ..... 66/172 E

* cited by examiner

*Primary Examiner*—Danny Worrell
(74) *Attorney, Agent, or Firm*—John Lezdey & Assoc

(57) ABSTRACT

There is provided a method for preventing deknitting of knitted tubular articles or garments such as gloves, socks, and the like. Accordingly, the edge of the tubular article or garment is provided with a plurality of horizontally knit rows of thread or yarn which are stretchable or elastic, and a vertical stretchable or elastic yarn or thread is knitted over and around 2 to 12 rows of the horizontal knit rows with gradually increasing tension so as to cause the edge to curl or roll over as a result of the vertical knit.

13 Claims, 1 Drawing Sheet

METHOD TO PREVENT DEKNITTING

FIELD OF THE INVENTION

The present invention relates to the prevention of fraying or deknitting of tubular knitted articles and parts thereof. More particularly, there is provided a means to prevent fraying at the edge of tubular knitted parts such as gloves, pants, socks, etc. and to simultaneously provide a rollover cuff.

BACKGROUND OF THE INVENTION

Knitted articles tend to deknit and fray at points of stress. In the case of a glove, a tear causes a tendency to run and make the glove unusable. It will be appreciated that there is more of a tendency to create a run due to stress at the raw edge of such a glove than from an inner area spaced from an edge. Thus, there is a tendency for excessive stress to be created when donning a glove at the cuff. It is further desirable to provide a means for gripping which would not cause irritation at the edge to the wearer.

Knitted garments such as pants and turtle neck shirts and sweaters are particularly stressed at their edges because the elastic edge must first be stressed to go over the head as is the case of a shirt or sweater and to stretch over a foot or shoe when it is a pant leg. In turtle neck sweaters it is desirable to provide a rollover at the edge to prevent irritation from a reinforcing edge member.

U.S. Pat. No. 4,479,368 to Gloeckler, which is herein incorporated by reference, discloses a programmable knitting machine which may be used in the present invention.

U.S. Pat. No. 4,987,614 to Murray discloses a method for providing reinforcing portions in the crotch region between adjacent finger stalls using the application of Merrow stitching or overedging stitch. However, this type of stitch is not at the edge and will not cause rollover.

U.S. Pat. No. 5,745,919 discloses a protective knit glove wherein the edge of the cuff is hemmed to prevent unraveling.

U.S. Pat. No. 2,342,547 to Kuehnel discloses a knitted mitten wherein the cuff is doubled upon itself. Cord is then fed with yarn wool in such a way that the cord covers the wool yarn on the outside of the glove while the yarn covers the cord on the inside of the glove.

U.S. Pat. No. 3,990,115 to Nester discloses a rolltop cuffless sock which has a permanent folded top portion. Elastic yarn is provided only in a circular horizontal knit and does not cause the rollover. Also, only one type of roll is formed.

SUMMARY OF THE INVENTION

The present invention relates to a means for reinforcing the edges of tubular knit articles to protect against fraying and to provide a curl or rollover at the edge. More particularly, a tubular knitted article such as a glove cuff, pant leg, neck portion of a turtleneck shirt or sweater is provided with a reinforcement and a rollover or curl at its edge. Accordingly, in a tubular knitted article which comprises a circular horizontal knit edge of elastic or stretchable material there is provided a perpendicular or vertical knit with an elastic or stretchable yarn which does not contain a twist.

The elastic yarn is applied over and around horizontal edge yarn by controlled tension whereby tension of the vertical elastic yarn gradually increases and tightens the horizontal knit so as to cause the edge to rollover or curl during knitting.

It is a general object of the invention to provide a means for preventing the fraying of knitted tubular articles and to provide a rollover or curled edge.

It is a further object of the invention to strengthen the cuff of a knitted glove against stress.

It is yet another object to provide an elastic edge to a knitted sock which prevents deknitting and is a rollover.

It is yet a further object to provide a method for controlling the type of roll.

These and other objects will become readily apparent when viewing the drawings and the description of preferred embodiments.

DETAILED DESCRIPTION OF THE DRAWINGS

The present invention now will be described more fully hereinafter with reference to the accompanying drawings, in which various embodiments of the invention are shown. This invention may, however, be embodied in may different forms and should not be construed as limited to the illustrated embodiments set forth herein; rather, these illustrated embodiments are provided so that this disclosure will be thorough and complete, and will fully convey the scope of the invention to those skilled in the art. Like members refer to like elements throughout.

Figure 1:
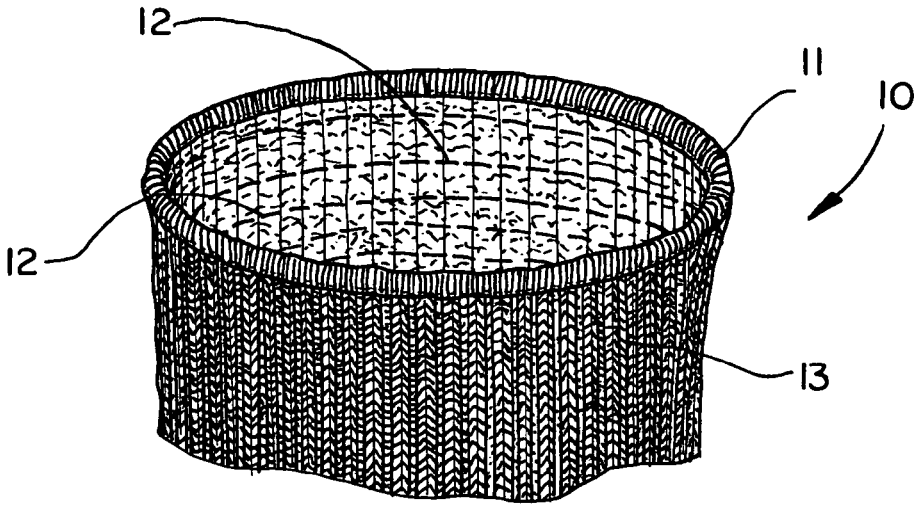
FIG. 1 PRIOR ART
FIG. 1 is a perspective view of an edge of a tubular article illustrating a prior art reinforcement.

As seen in FIG. 1, the edge 11 of a tubular article 10 is hemmed with thread completely around to prevent deknitting. There are horizontal rows 12 and vertical knit 13. However, it is essential to provide a curl that both the horizontal and vertical knit are elastic or stretchable. Also that the vertical knit extends over and around the edge between 2 to 12 horizontal rows and is gradually placed under tension so as to cause gradual curling during knitting.

Figure 2:
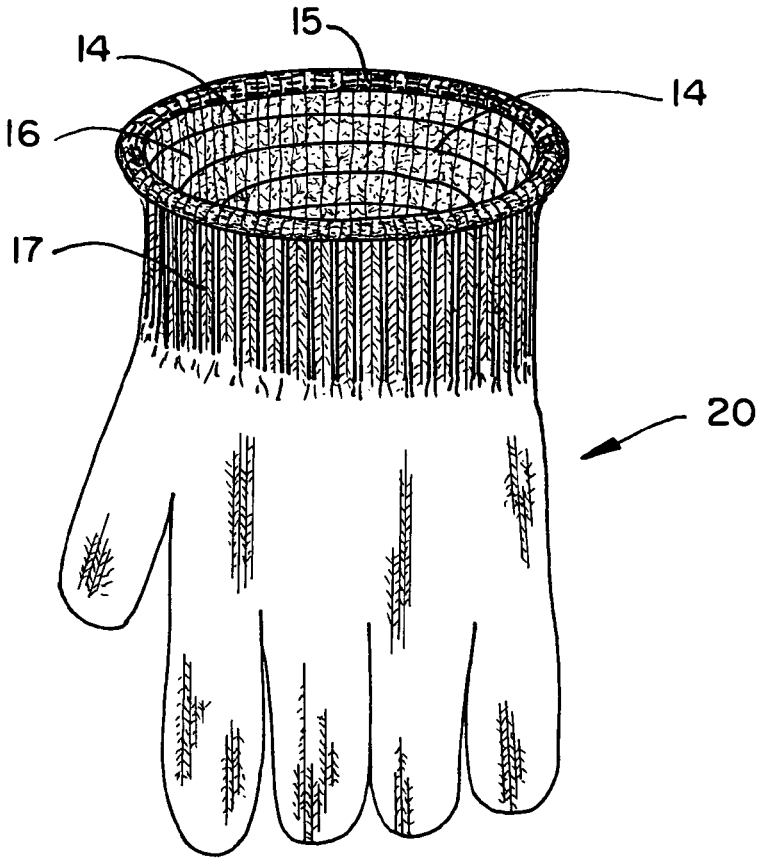
FIG. 2 is a perspective view of a knitted glove with a curled edge of the cuff according to the present invention.

FIG. 2 illustrates a glove 20 wherein the cuff 7 is formed with vertical and horizontal elastic yarn and the edge has curled or rolled over as a result of tension during knitting. The glove 20 has horizontal elastic knits 14 and vertical elastic thread or yarn 15 which is knitted around and over 2 to 12 rows of the horizontal knit. As the tension by the vertical thread or yarn gradually increases about the horizontal rows during knitting, the edge begins to curl or roll over. Depending upon the yarn or thread, the vertical yarn or thread can extend greater than 12 horizontal rows to obtain a suitable curl. The number of horizontal rows utilized also effects the type of roll formed.

It has been found that in order to obtain the roll over or curl it is necessary that both the horizontal and vertical yarn are either elastic or stretchable and that tension by the vertical yarn gradually increases. The elastic or stretchable vertical yarn tightens the horizontal and vertical.

The tubular article can be prepared separately and then sewn onto the base such as the wrist cuff onto a glove. It can be sewn to the base layer by overcast stitching (not shown). Alternatively, according to one method, a small diameter circular knitting machine such as a glove or sock machine may be used to knit a jacquard tubular fabric. A patterning mechanism is utilized which during the knitting process selects a yarn from a plurality of yarns which will be fed from a plurality of yarns presented to be fed to each needle on the knitting cylinder in a predetermined manner to form a predetermined pattern. In other words elastic yarn is fed to form horizontal rows and to finish off the article, vertical elastic yarns are then simultaneously placed on the top and over two or more rows being knit depending upon the thread or yarn and its denier and the type of roll over desired. The small number of horizontal rolls results in a tight roll.

The tubular article can be comprised entirely of elastic or stretchable thread or yarn or the elastic or stretchable thread or yarn can comprise only the area along the edge wherein the curl or roll over is desired.

The invention can be carried out as follows. For example, in a knitted glove, the body of the glove can be prepared on any conventional knitting machine used in the glove making industry such as a Jacquard or Shima knitting machine. When the cuff is to be prepared, elastic or stretchable yarns are utilized having a denier size of 100 to 1000. The cuff is knitted in a conventional manner except when the top of the cuff is to be knit at a predetermined time pursuant to a program or other adjustments of the machine, a first yarn carrier is provided with an elastic or stretchable yarn for a vertical knit. A second yarn carrier is provided with an elastic or stretchable yarn for the horizontal preferably Weft knit, which may be of the same kind or size or a different kind or size. The second yarn carrier starts across the machine placing the yarn in select needle(s) wherein the yarn knits in the vertical direction. As the needle(s) pulls down on the yarn it causes the yarn to stretch. As the yarn comes off the needle(s), this causes the yarn to try to go back to its original state. This action causes the two yarns to pull against each other and the gradual increasing tension causes the knit material to roll. The extent of the roll depends upon the number of horizontal rows involved. About 2 to 12 horizontal rows is sufficient in most cases. One or more needles may be used, preferably 1 to 4. The number of rows will determine the size of the roll.

Although the operation is described with regard to a knitted glove, the same operation is performed in the preparation of knit turtle neck shirts, socks, pants and the like.

Although the invention can be practiced on conventional knitting machines such as a Shima knitting machine, it is preferable to employ a programmable knitting machine such as a Jacquard knitting machine which includes at least one grooved holder to receive traversely sliding needles which are activated by a carriage displacable in the longitudinal direction of the needles to place the vertical threads on yarn. One such knitting machine is disclosed in U.S. Pat. No. 4,479,368 to Gloeckler which is herein incorporated by reference.

A wide variety of materials may be employed as the elastic yarn or thread. As used herein and in the claims, the term "elastic" has its usual broad meaning, which may be conveniently defined as meaning a material which is elongatable by at least 25% of its relaxed length, i.e., which by stretching may be elongated to at least one and one-quarter times its relaxed length (an elongation of 25%), and which will recover upon release of The stretching, i.e. tensioning, force at least 40% of its elongation. According to this definition, upon release of the tensioning force at 25% elongation, the material must recover to not more than 15% elongation. For example, under the foregoing definition a material is deemed to be elastic if a piece of it 100 centimeters ("cm") in length can be stretched to elongate it to a length of at least 125 cm and if, in the case of being stretched to 125 cm, upon release of the elongating force it recovers to a length of not more than about 115 cm. Of course, many elastic materials will be elongatable by much more than 25% of their relaxed length and many of these will recover to, or close to, their original relaxed length upon release of the tensioning force. The yarn denier is from 1 to 1000, preferably about 250–500. The yarn is horizontal and vertical rows can be the same kind or denier or different.

The term "stretchable" is intended to include yarn or thread which can be elongated because of mechanical processing such as by crimping or by processing with an elastic coating.

It is understood that the term "yarn" as used herein and throughout the claims is meant to include "thread" or "tow" which is used to make a knit-like garment.

Any of the conventional elastomeric fibers may be utilized such as SPANDEX® and LYCRA®. However, other suitable fibers may comprise polyester elastomeric materials, polyurethane elastomers, elastomeric thermoplastic resins blending with polyolefins, e.g. polyethylene, polypropylene or copolymers thereof, block copolymers having thermoplastic polystyrene end blocks natural and synthetic rubbers and the like and blends thereof.

EXAMPLE 1

A 13 gauge Shima glove knitting machine was utilized to make the base of a knitted glove. The cuff portion was partially prepared with horizontal rows of an elastic knit yarn (LYCRA®).

To complete the cuff there was used a first yarn carrier for providing a vertical knit and a second yarn carrier which was providing horizontal rows of chain knit. Two needles were used for each of the horizontal rows of chain knit. Two needles were used for the vertical knits. Each yarn carrier started across select needles. The first yarn carrier putting its yarn into the needles and pulling down on the yarn so as to cause the yarn stretch and pull against the other yarn. As the yarn comes off the needles the yarn tries to go back to its natural state. The vertical yarn proceeded over eight rows at the top of the glove there was increasing tension from the stretch so the top of the cuff started to curl as the knit proceeded about the top of the cuff.

Having described specific preferred embodiments of the invention with reference to the accompanying drawings, it will be appreciated that the present invention is not limited to those precise embodiments, and that various changes and modification can be effected therein by one of ordinary skill in the art without departing from the scope or spirit of the invention as defined by the appended claims.

What is claimed is:

1. A method for preventing deknitting at an edge of a knitted tubular article or part of a garment which comprises providing at said edge a plurality of rows of horizontally course knit elastic or stretchable yarn or thread and knitting over said course rows a wale knit elastic or stretchable yarn or thread using gradually increasing tension as it circles around said edge so that the yarns or thread pull against each other as a result of said tension to cause curling of said course rows along the edge during knitting and tighten both the course and wale yarns.

2. The method of claim 1 wherein said course rows which are provided with a wale knit range from 2 to 12 rows.

3. The method of claim 1 wherein said wale knit comprises a thread.

4. The method of claim 1 wherein said wale knit comprises a yarn.

5. The method of claim 1 wherein said tubular article comprises a cuff for a glove.

6. The method of claim 1 wherein said tubular article comprises a pant leg.

7. The method of claim 1 wherein said tubular article comprises a turtle neck shirt.

8. A method for preventing a knit cuff of a glove from deknitting at its edge which comprises providing the edge of said cuff with a plurality of horizontal course knit rows of elastic or stretchable yarn or thread and then knitting vertically over and around 2 to 12 rows of said course knit rows an elastic or stretchable yarn or thread wales with gradually increasing tension on said wale yarn or thread so as to cause the edge to curl during knitting as a result of the wale knit.

9. The method of claim 8 wherein said wale knit is with a thread.

10. The method of claim 8 wherein said glove is a knit on a programmable knitting machine.

11. A knitted tubular article or garment having a rolled over edge prepared by the method of claim 1.

12. A knitted tubular article having a rolled over edge prepared by the method of claim 2.

13. A knit cuff for a glove prepared by the method of claim 8.

* * * * *